US005526794A

United States Patent [19]

Messih et al.

[11] Patent Number: 5,526,794

[45] Date of Patent: Jun. 18, 1996

[54] ELECTRONIC CONTROLLER FOR ACCURATELY CONTROLLING TRANSIENT OPERATION OF A PHYSICAL SYSTEM

[75] Inventors: Isis A. Messih, Troy; Frederick A. Page, Canton, both of Mich.; Joseph N. Ulrey, Hiroshima, Japan

[73] Assignee: Ford Motor Company, Dearborn, Mich.

[21] Appl. No.: 215,548

[22] Filed: Mar. 22, 1994

Related U.S. Application Data

[63] Continuation-in-part of Ser. No. 151,680, Nov. 15, 1993, Pat. No. 5,353,768.

[51] Int. Cl.[6] ..... F02D 41/10; F02D 41/12

[52] U.S. Cl. ..... 123/492; 123/493; 364/431.05

[58] Field of Search ..... 123/480, 492, 123/493, 491; 364/431.05

[56] References Cited

U.S. PATENT DOCUMENTS

| | | | |
|---|---|---|---|
| 4,401,087 | 8/1983 | Ikeura | 123/492 |
| 4,408,279 | 10/1983 | Imai et al. | 123/492 X |
| 4,620,519 | 11/1986 | Nagao et al. | 123/492 |
| 4,682,577 | 7/1987 | Kato et al. | 123/492 |
| 5,353,768 | 10/1994 | Messih et al. | 123/492 X |

FOREIGN PATENT DOCUMENTS

| | | | |
|---|---|---|---|
| 63-129141 | 6/1988 | Japan | 123/492 |

*Primary Examiner*—Tony M. Argenbright
*Attorney, Agent, or Firm*—Peter Abolins; Roger L. May

[57] ABSTRACT

An electronic engine controller (EEC) controls the delivery of fuel to an internal combustion engine via one or more fuel injectors by executing a background routine to measure a plurality of system conditions including airflow and engine temperature. A response value is generated as a function of an aircharge value, the temperature value and a valve effect value. The EEC detects an interrupt which occurs prior to combustion of an air/fuel mixture within each combustion chamber of said engine, and in response to the interrupt execution of the background routine is halted and a foreground routine is executed in which the airflow is measured, an updated aircharge value is generated and the response value is updated as a function of the difference in aircharge values and a predetermined response alteration value. The aircharge value is replaced with the updated aircharge value. A base fuel injector signal, generated by known methods, is modified by the response value, and execution of the background routine is restarted upon completion of the foreground routine.

19 Claims, 6 Drawing Sheets

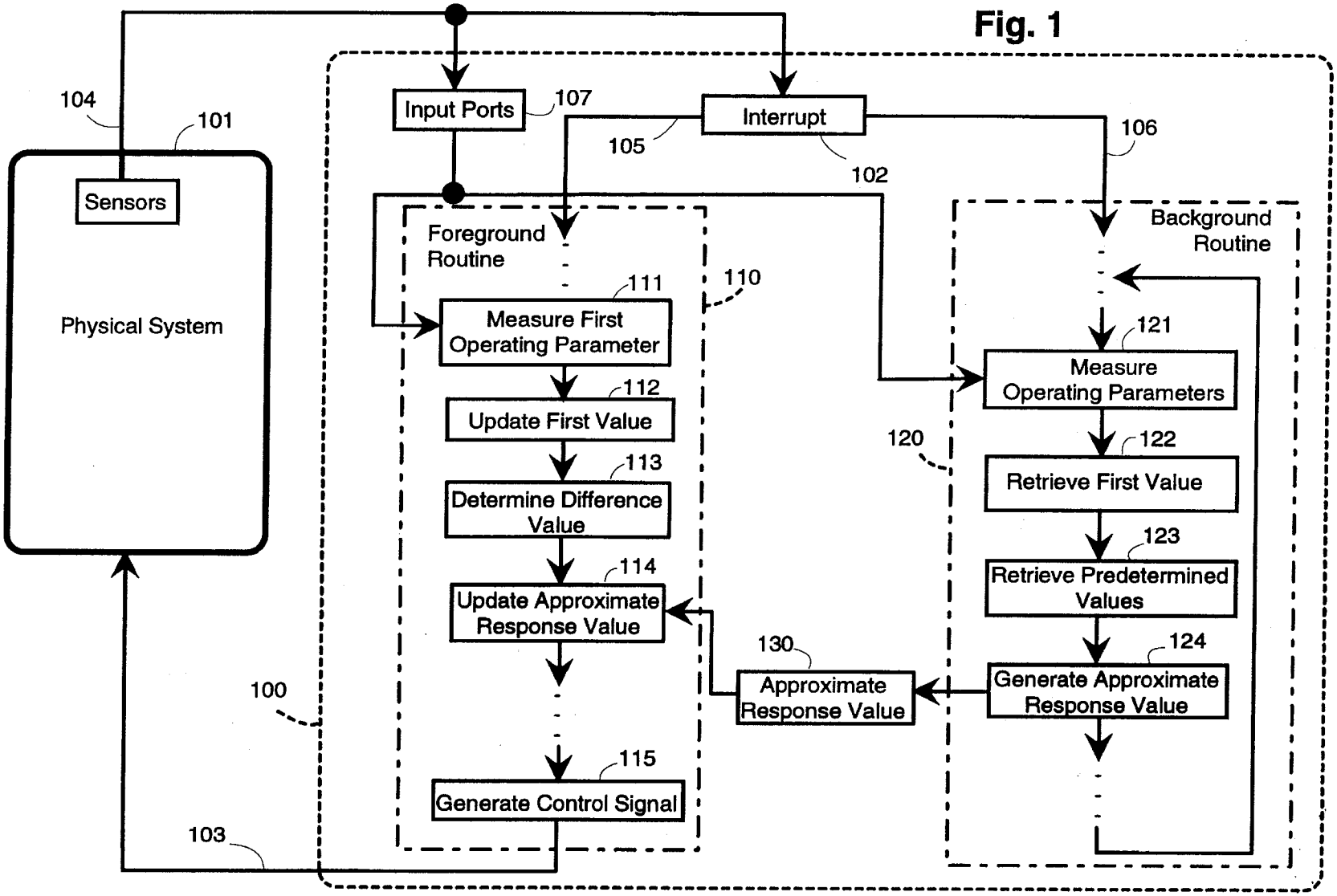
Fig. 1
Background Routine
Measure Operating Parameters
Retrieve First Value
Retrieve Predetermined Values
Generate Approximate Response Value
Approximate Response Value
Interrupt
Input Ports
Foreground Routine
Measure First Operating Parameter
Update First Value
Determine Difference Value
Update Approximate Response Value
Generate Control Signal
Sensors
Physical System
100
101
102
103
104
105
106
107
110
111
112
113
114
115
120
121
122
123
124
130

Enter
201
Calculate CYL_AIR_CHG
202

TFC_FG_EN = 1 ?
203
NO
YES
DELTIME = CLOCK - TFC_TME_LST
204
Calculate EISF_FG
205
EISF_FG - AISF <= TFCBITS or |(EISF_FG - AISF)/ EISF_FG| <= TFCDED ?
206
NO
YES
EFTR = (EISF_FG - AISF) / EFTC TFC_FUEL = EFTR * TFC_MULT
207
AISF = AISF +(EFTR * DELTIME) TFC _TME_LST = CLOCK
209
EFTR = (EISF_FG - AISF)/ EFTC TFC_FUEL = 0
208
Return
210

ELECTRONIC CONTROLLER FOR ACCURATELY CONTROLLING TRANSIENT OPERATION OF A PHYSICAL SYSTEM

The present application is a continuation-in-part of U.S. patent application Ser. No. 08/151,680, filed Nov. 15, 1993, entitled "A Fuel Control System with Compensation for Intake Valve and Engine Coolant Temperature Warm-Up Rate" which issued on Oct. 11, 1994 as U.S. Pat. No. 5,353,768.

FIELD OF THE INVENTION

This invention relates to methods and apparatus for accurately controlling the response of a physical system to transient operating conditions and more specifically, though in its broader aspects, not limited to, methods and apparatus for accurately compensating for the fuel delay caused by induction system wetting effects during transient engine operation.

BACKGROUND OF THE INVENTION

Electronic controllers are often utilized to control various aspects of physical systems. Such controllers receive information from the physical system, process the information and generate one or more control signals to control certain aspects of the operation of the physical system. Although such controllers allow a great deal of information to be processed in a brief period of time, certain physical systems, by virtue of their complexity and speed of operation, impose significant demands on such controllers to generate accurate control signals in response to rapidly changing conditions.

For instance, related U.S. Pat. No. 5,353,768, noted above, and entitled "A Fuel Control System with Compensation for Intake Valve and Engine Coolant Temperature Warm-Up Rates" discloses a fuel controller which improves engine performance, particularly during warm-up, by controlling the amount of fuel delivered to the engine in a manner that is consistent with the vaporization rate of fuel during engine warm-up. In such a system, particularly during transient operation, it is desirable to alter the fuel delivery rate upon firing of each cylinder within the engine in order to provide optimal engine response. Such a manner of control requires the controller to perform a significant number of calculations in a brief period of time in order to accurately control the delivery of fuel to the engine. Because of the large number of computational steps which the controller must perform to adequately compensate for the rapidly changing vaporization rate of fuel, in addition to controlling other aspects of engine operation, the full computation is not performed before the firing of each cylinder. Consequently, although such a manner of control provides for improved engine response, the response generated by the controller may not always be based upon contemporaneous engine conditions. Accordingly, there exists a need for an electronic controller which can accurately alter the operation of a physical system, such as an internal combustion engine, in response to rapidly changing external conditions by generating control signals in response to contemporaneous system conditions, which may require time consuming computationally intensive operations within the controller.

SUMMARY OF THE INVENTION

It is an object of the present invention to improve the response of a physical system to rapidly changing conditions by detecting the changes in the conditions and rapidly altering certain aspects of system operation in response to the detected conditions.

In accordance with the present invention, the above object is achieved by employing an electronic controller to generate a control signal by executing a first routine in the controller to generate an approximate response value. The first routine generates the approximate response value by measuring a plurality of operating parameters, retrieving one or more predetermined values in response to the measured operating parameters and retrieving a first value indicative of a first measured operating parameter, where first measured operating parameter varies at a substantially faster rate than the plurality of operating parameters. The approximate response value is generated as a function of the first value and the predetermined values. In response to a predetermined event, execution of the first routine is halted and the approximate response value is updated by executing a second routine which includes the steps of, measuring the first operating parameter to generate an updated first value, determining a difference value indicative of a difference between the first value and the updated first value, replacing the first value with the updated first value and updating the approximate response value as a function of the difference value. The control signal is then generated as a function of at least the updated approximate response value and execution of the first routine is continued.

An advantage of at least certain preferred embodiments is that system performance is improved by the increased accuracy in system control which is provided by calculating a response as a function of a variety of conditions and quickly updating the response and generating the control signal in response to contemporaneous system conditions.

These and other features and advantages of the present invention may be better understood by considering the following detailed description of certain preferred embodiments of the invention. In the course of this description, reference will be made to the attached drawings.

BRIEF DESCRIPTION OF THE DRAWINGS

FIG. 1 is a schematic block diagram of a physical system and an electronic controller which embody the principles of the invention

DETAILED DESCRIPTION

Figure 2:
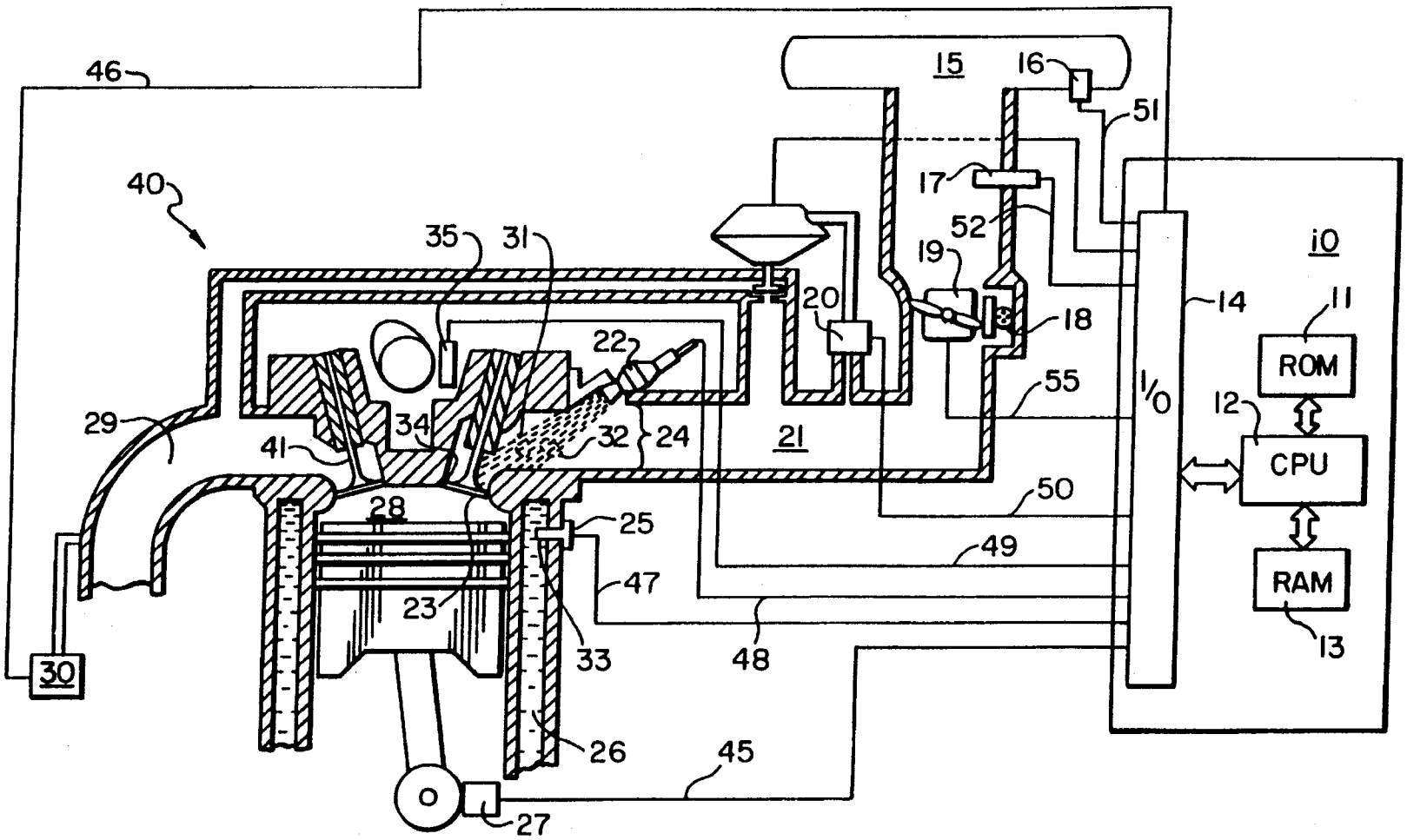
FIG. 2 is a schematic, partially cross-sectional illustration of an internal combustion engine and an electronic engine controller which embody the principles of the invention.

FIG. 1 of the drawings shows a physical system 101 which receives a control signal 103 generated by an electronic controller 100 to control certain aspects of operation of the physical system 101. Physical system 101 periodically transmits signals generated by sensors, which indicate certain aspects of system operation over signal lines seen at 104 to electronic controller 100.

Electronic controller 100 preferably takes the form of a microcontroller and memory which contains programs for execution by the microcontroller. Such microcontrollers typically contain input and output ports through which data is received and transmitted, read only memory for storing control programs, random access memory for temporary data storage which may also be used for counters or timers, non-volatile memory for storing learned values, and a conventional data bus.

Electronic controller 100 receives signals transmitted over signal lines 104 by input ports seen at 107 and by interrupt inputs seen at 102. As seen in FIG. 1, electronic controller 100 is advantageously programmed to execute a background routine seen at 120 and a foreground routine seen at 110 to generate control signal 103 which controls certain predetermined aspects of operation of physical system 101. Electronic controller 100 preferably generates control signal 103 by executing the background routine in the controller 100 to generate an approximate response value. The approximate response value is generated by measuring a plurality of operating parameters, retrieving a first value indicative of a first measured operating parameter, retrieving one or more predetermined values in response to the measured operating parameters, the first measured operating parameter varying at a substantially faster rate than said plurality of operating parameters, and generating the approximate response value as a function of the first value and the predetermined values. Upon detection of a predetermined event, execution of the background routine 120 is halted and the approximate response value is updated by executing the foreground routine 110 which includes the steps of, measuring the first operating parameter to generate an updated first value, determining a difference value indicative of a difference between the first value and the updated first value, and updating the approximate response value as a function of the difference value. The control signal is generated as a function of at least the updated approximate response value. Execution of the background routine is then restarted upon completion of the foreground routine. The predetermined values are preferably empirically derived and are stored in the read-only memory. The predetermined event is preferably a hardware generated interrupt. In alternative embodiments the predetermined event may be a software generated interrupt or the setting of a particular semaphore to a predefined state. The response value is preferably updated by generating a change value as a function of the difference value and a response alteration value which is indicative of a change in said response value per change in said first measured parameter, and generating the updated response value by adding the change value to the response value.

As seen in FIG. 1, the steps shown in the background routine 120 and the foreground routine 110 comprise only a portion of the respective routine. Each routine advantageously performs a variety of functions to control a plurality of operating parameters for physical system 101. Background routine 120 comprises a plurality of steps, four of which are shown in FIG. 1, which are executed in a loop by electronic controller 100 in a substantially continuous fashion in the absence of interrupts. Background routine 120 advantageously performs calculations which are computationally intensive in that they require a significant number of calculations by electronic controller 100 to be performed. At 121 a plurality of operating parameters are retrieved from the input ports seen at 107. These parameters are measured by sensors in physical system 101 each of which transmits values indicative of a particular aspect of operation of physical system 101. At 122 a first value which was previously stored by EEC 10 and which is indicative of a first measured operating parameter is retrieved. At 123 a plurality of empirically derived predetermined values are retrieved from read-only memory by generating index values from certain measured parameters and retrieving a stored value corresponding to the index values. The values retrieved at step 123 are used at step 124, along with the retrieved first value to calculate an approximate response value which is stored in a location in memory as seen at 130. After step 124, execution of the background routine continues until the detection of a predefined interrupt by electronic controller 100.

Upon detection of an interrupt, execution of the background routine 120 is halted and execution of foreground routine is initiated to generate one or more real-time responses to physical system 101, such as the generation of control signal 103 which controls a certain aspect of operation of physical system 101. The operations performed in foreground routine 110 are advantageously selected to minimize the number of steps performed in response to the interrupt in order to allow the rapid generation of control signal 103 and other control signals. Foreground routine 110 advantageously utilizes values, such as approximate response value 130, calculated by background routine 120 to decrease the number of steps, and hence the amount of time, required to generate control parameters for physical system 101, such as control signal 103. At 111 the first operating parameter is measured at 121, and an updated value indicative of the measured first operating parameter is generated at 112. At 113, a difference value indicative of the difference between the first value and the updated first value is generated. At 114 the approximate response value generated at 124 is updated by multiplying a predetermined response alteration value by the difference value and adding the resulting value to the approximate response value stored at 130. The predetermined response alteration value is preferably an empirically derived value which represents an estimated change in the response value per unit change in the first measured parameter. A variety of other steps are executed in the foreground routine after step 114, including replacing the first value with the updated first value for subsequent use by background routine 120, and at step 115 control signal 103 is generated. After execution of step 115, execution of the foreground routine is terminated and execution of the background routine is continued.

Figure 3:
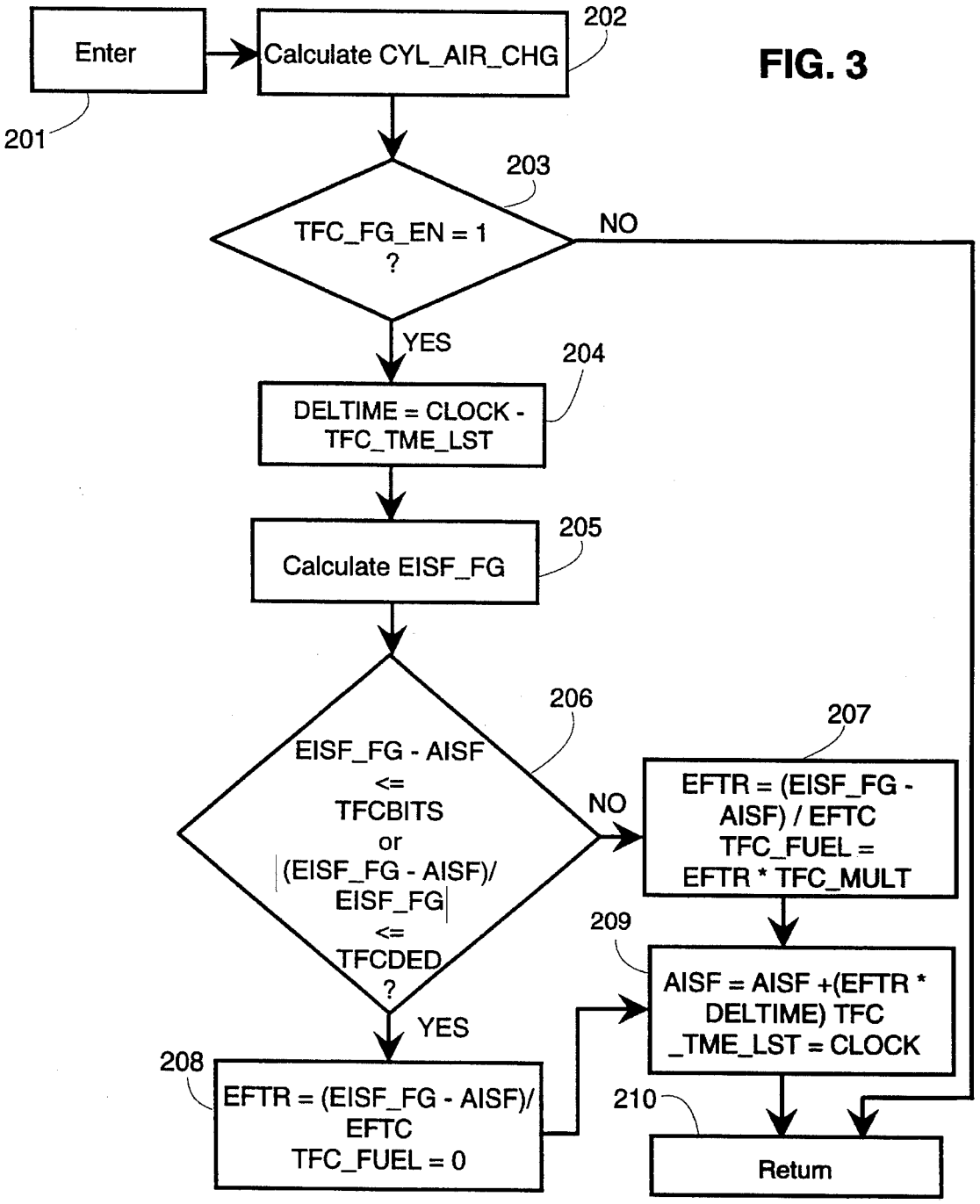
FIGS. 3, 4(*a*), 4(*b*) and 4(*c*) are flowcharts showing the operation of a preferred embodiment of the invention.
Figure 4A:
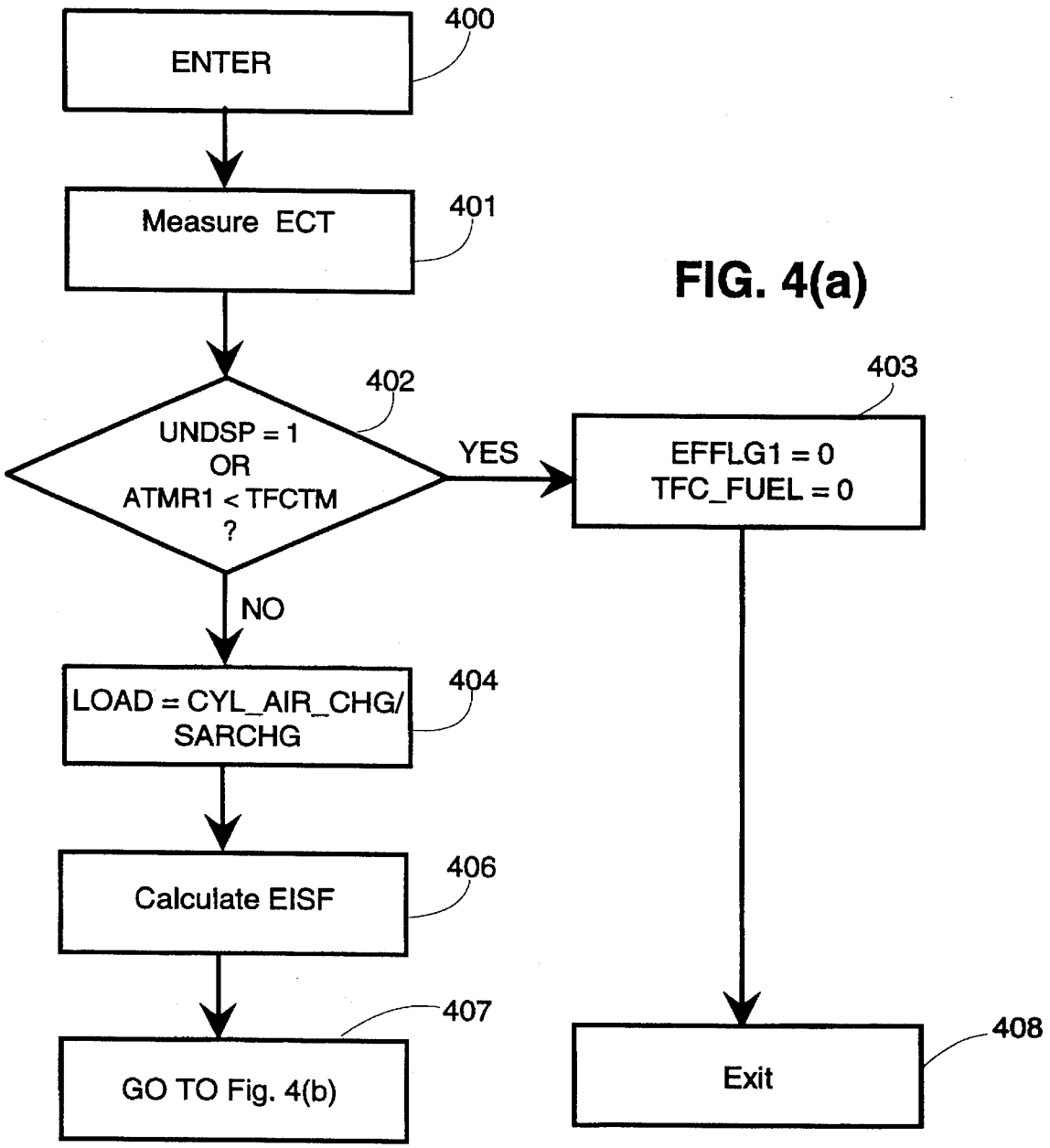
Figure 4B:
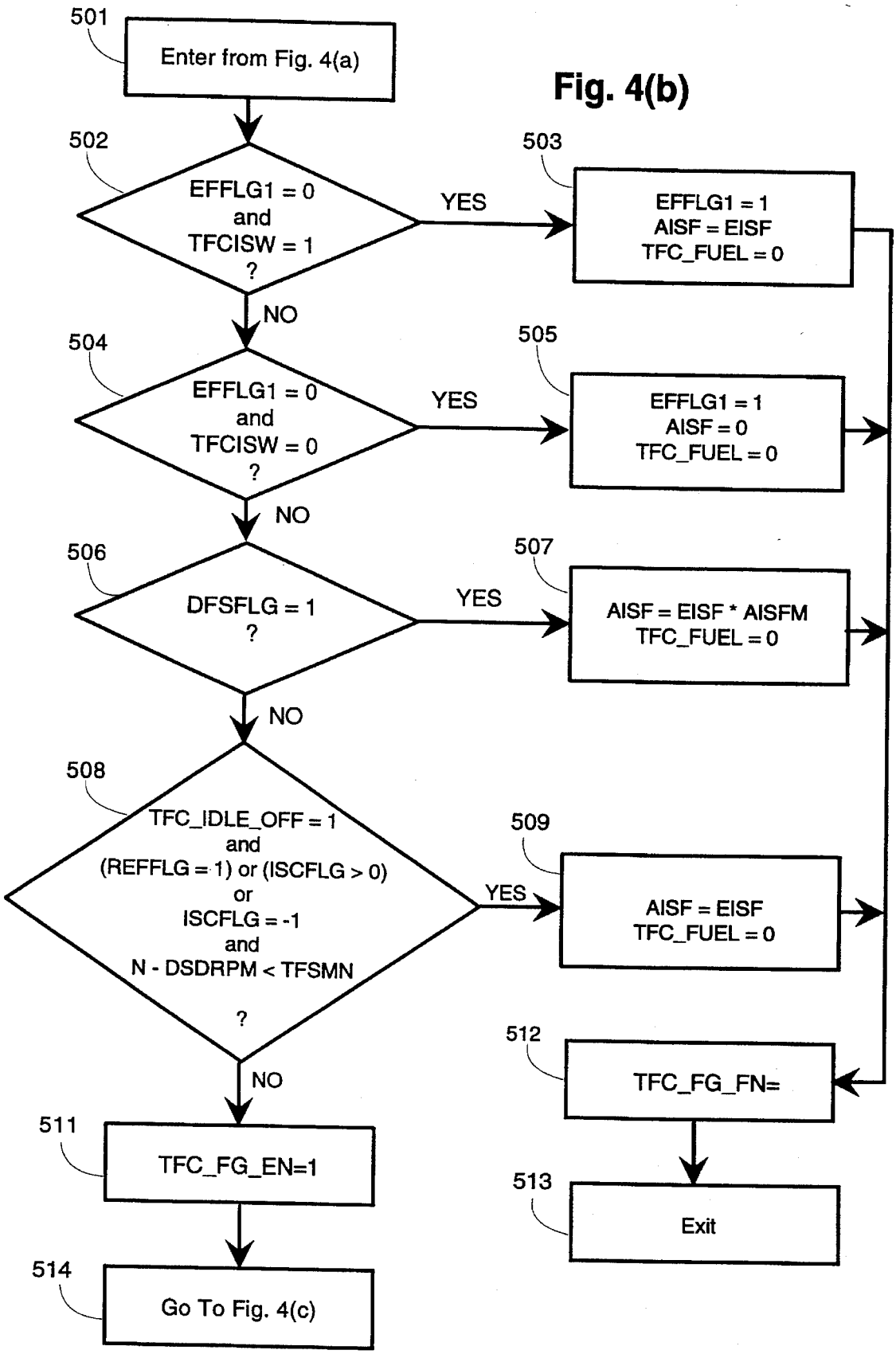
Figure 4C:
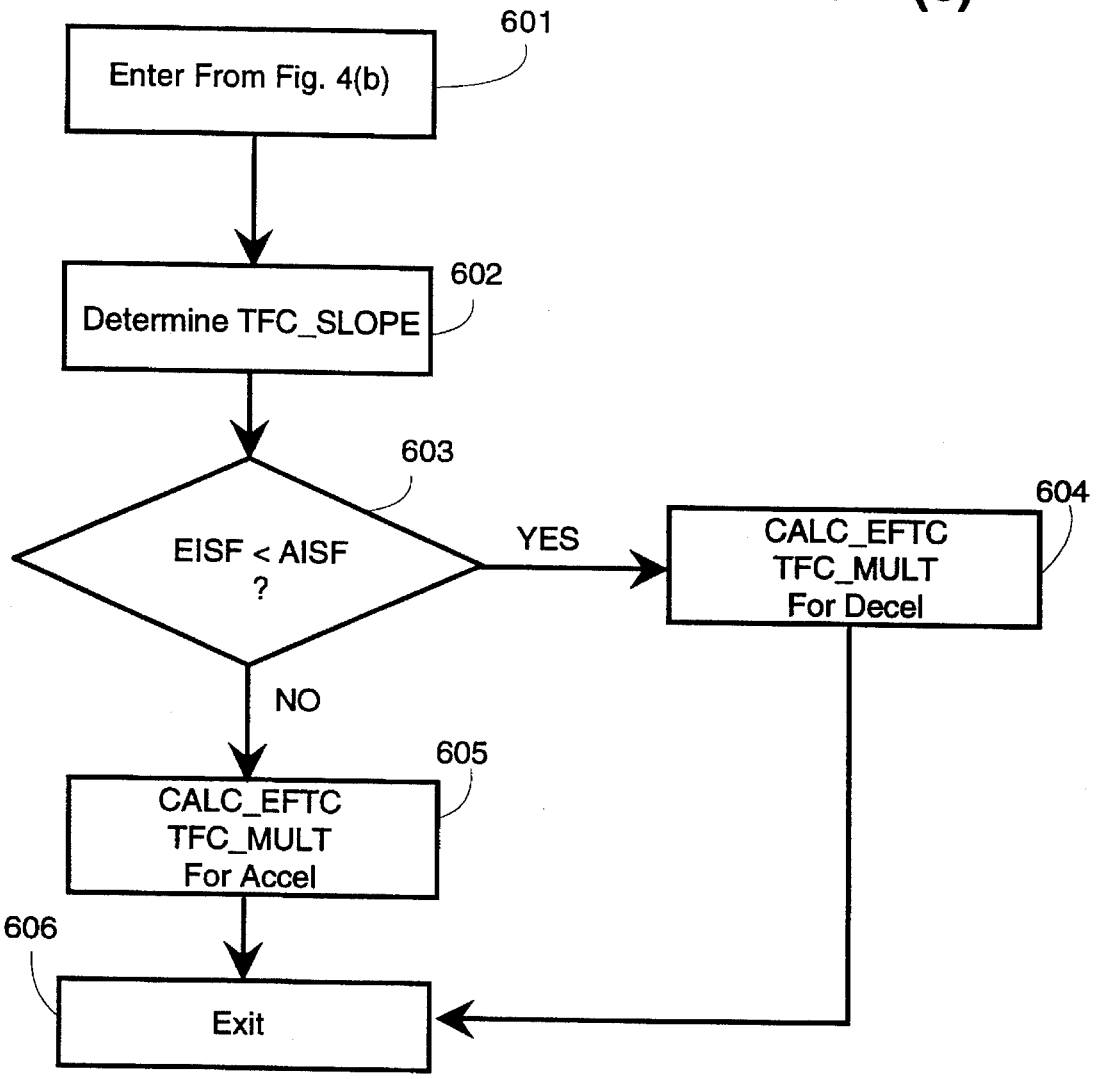

FIGS. 2, 3 and 4(*a–c*) show a particular application of electronic controller 100 to a physical system 101. In FIG. 2 an internal combustion engine 40 corresponds to physical system 101 shown in FIG. 1. Internal combustion engine 40 comprises a plurality of cylinders and combustion chambers 28, one of which is shown in FIG. 2. The engine 40 is controlled by an electronic engine controller (EEC) 10 which corresponds to electronic controller 100 in FIG. 1. EEC 10 receives a plurality of signals from the engine, including an engine coolant temperature (ECT) signal 47 from an engine coolant temperature sensor 25 which is exposed to engine coolant circulating through coolant sleeve 26, a cylinder identification (CID) signal 49 from a CID sensor 35, a throttle position signal 55 generated by a throttle position sensor 19, a profile ignition pickup (PIP) signal 45 generated by a PIP sensor 27, a heated exhaust gas oxygen (HEGO) signal 46 from a HEGO sensor 30, an air intake temperature signal 51 from an air temperature sensor 16, and an air flow signal 52 from an air flow meter 17. The EEC 10 processes these signals received from the engine and generates a fuel injector signal transmitted to fuel injector 22 on signal line 48, which corresponds to signal line 103 in FIG. 1, to control the amount of fuel delivered by fuel injector 22. Intake valve 23 operates to open and close intake port 34 to control the entry of an air/fuel mixture into combustion chamber 28. PIP sensor 27 generates a series of signals, each cylinder marking an event termed herein as a cylinder event, which preferably occurs ten degrees before top dead center of every cylinder.

Engine coolant circulating through coolant sleeve 26 operates to dissipate heat generated from the ignition of the air/fuel mixture in combustion chamber 28. Air drawn through air intake 15 passes by air temperature sensor 16, air flow meter 17 which senses the mass flow rate of air, throttle position sensor 19 and into induction system 21 which includes an intake port 34. A portion of the fuel from fuel injector 22, seen at 32, directly impacts the walls 24 of the induction system 21, the temperature of which is a function of the engine coolant temperature as sensed by coolant temperature sensor 25 and transmitted to the EEC 10 via signal line 47. Another portion of the fuel injected by injector 22, seen at 31, directly impacts the intake valve 23, which is less affected by the temperature of the engine coolant than are the walls 24 of the induction system. Some of the fuel which directly impacts the walls 24 then is drawn into combustion chamber 28, while the remainder is left on the walls 24 as a residue.

A preferred embodiment of the present invention advantageously controls the delivery of fuel to the intake port in a manner which compensates for the fuel delay caused by induction system wetting effects by generating a base fuel value according to any of a variety of known methods, including open-loop and closed-loop control methods, in a background routine executed by the controller, measuring an engine temperature value indicative of the temperature of the engine, retrieving an aircharge value indicative of the air mass in a cylinder and generating an equilibrium fuel mass value indicative of the fuel mass residing within the induction system during steady state operation of the engine at the temperature value and aircharge value. As can be seen by those skilled in the art in view of the present disclosure, the aircharge value corresponds to the first value as described above and the equilibrium fuel mass value corresponds to the response value as described above.

In response to an interrupt generated upon each revolution of the engine, a foreground routine is executed by the controller to update the equilibrium fuel mass value. An updated aircharge value is generated by detecting the voltage on signal line 52 which is indicative of the air flow rate into the induction system. An aircharge is then generated as a function of the detected air flow rate and the time between cylinder events as indicated by PIP signal 45. A difference value indicative of a difference between the first and the updated first aircharge values is calculated and an updated equilibrium fuel mass value is generated as a function of the difference value. The fuel injector signal is then subsequently generated as a function of the updated equilibrium fuel mass value, the foreground routine is exited and execution of the background routine is continued.

FIG. 3 of the drawings is a flowchart showing the general steps taken by the preferred embodiment to calculate an amount of fuel to be delivered by injector 22. The steps shown in FIG. 3 are initiated upon detection by the microprocessor 12 of a hardware driven interrupt as generated by the PIP sensor 27 and transmitted to the EEC 10 via signal line 45. As previously explained, the interrupt generated by the PIP sensor occurs ten crankshaft degrees before top dead center. At 202, a load value CYL_AIR_CHG, representative of cylinder air charge in lbs/cylinder, is calculated from the rate of air flow into the air intake 15 as detected by the hot wire air meter 17 and as a function of the angular speed of the engine as determined from the signals transmitted over signal line 45. The load value CYL_AIR_CHG is preferably calculated by measuring the mass flow rate of air into the induction system over the period of time between cylinder events and integrating the measured values over such period of time. This advantageous feature allows an accurate value of CYL_AIR_CHG to be generated by determining a plurality of instantaneous air flow rates and integrating the values over the period of time over which they are measured.

At 203 a flag TFC_FG_EN is checked to determine if a transient fuel calculation is required. TFC_FG_EN is generated in the background routine shown in FIGS. 4(*a*) to (*c*) to be discussed below. If transient fuel control is required then TFC_FG_EN will have a value of 1 and if not, then it will have a value of 0, and the routine will be exited at 210. If transient fuel control is required, then at step 204 an elapsed time value, DELTIME, is calculated by subtracting a predetermined time interval value TFC_TME_LST from a real time value CLOCK, as generated by a real time clock contained in the EEC 10.

At step 205, an equilibrium fuel mass value, EISF_FG, is calculated. This value, which corresponds to the updated response value described above and is indicative of the fuel mass on the walls 24 of the intake manifold 21 when the engine is operating under steady state conditions, is calculated by modifying EISF with a value indicative of the change in fuel mass on the interior surfaces of the induction system for a particular change in aircharge, as shown in the following relationship:

$$EISF_FG=EISF+[(CYL_AIR_CHG-TFC_CHG)*TFC_SLOPE] \quad (1)$$

where,

EISF is an approximate response value, representative of the fuel mass residing on the walls of the intake port when the engine is operating under steady state conditions, which is calculated during a background loop to be described in FIGS. 4(*a*)–4(*c*), CYL_AIR_CHG is the value calculated at step 202, TFC_CHG represents the air charge at which EISF was calculated, and TFC_SLOPE represents the change in fuel mass on the walls of the intake port per change in air charge. TFC_SLOPE corresponds to the response alteration value as described above.

As can be seen from the relationship expressed in equation (1), if the air charge detected at step 202 and represented by the variable CYL_AIR_CHG, is the same as the air charge which existed when EISF was calculated in the background loop (TFC_CHG), then EISF_FG will simply be equal to EISF. A preferred embodiment of the present invention advantageously calculates EISF_FG in order to alter the value EISF, which is calculated a certain time period earlier, if engine load has varied since EISF was calculated. Consequently, the number of steps to be executed by the foreground routine shown in FIG. 3 is reduced by calculating a value for the equilibrium fuel mass in the lower priority background routine and updating the value in the higher priority foreground routine which must respond to real-time interrupts. As will be explained in the description accompanying FIGS. 4(*a*) to 4(*c*), the value EISF is calculated by forming index values to retrieve certain predetermined values stored in ROM 11, retrieving the values and calculating EISF as a function of the retrieved values. These time and computationally intensive tasks are performed in the background routine to be described. EISF is then updated in the interrupt routine shown in FIG. 3. The reduced calculation time required to generate an accurate engine response advantageously allows fuel delivery to be altered upon each cylinder event rather than at longer and variable time durations determined by execution time required by the background routine, a portion of which is shown in FIGS. 4(*a*) to (*c*).

At 206, two comparisons are made to determine if the difference between the equilibrium fuel mass and an actual fuel mass value (AISF) is sufficient to require transient fuel compensation. A preferred embodiment of the present invention advantageously utilizes a deadband value, represented in FIG. 3, at 206 by the values TFCBITS and TFCDED, which represent respectively, a fixed value and a percentage value, against which the value EISF_FG–AISF is compared. TFCBITS prevents transient fuel compensation if the difference between the equilibrium fuel mass and actual fuel mass is sufficiently small so as to be attributable to inadequate resolution in the EEC 10 in the calculation of the EISF_FG or AISF. In the case of TFCDED, which represents a percentage difference between the equilibrium or steady state fuel value and the transient fuel value, the percentage difference between EISF_FG and AISF is determined and compared.

If the difference between the equilibrium fuel mass value and the actual fuel mass value is of a sufficient value, then at 207 a value EFTR, representative of an equilibrium transfer rate of fuel from the walls of the intake port to the combustion chamber, is calculated according to the following relationship:

$$EFTR=(EISF_FG-AISF)/EFTC \quad (2)$$

where,

EFTC is a time constant representative of a rate of change of the fuel mass,

EISF_FG is as explained above, and

AISF is a value representative of the actual fuel film mass residing on the walls 24 of the intake port 21 when the engine is operating under transient conditions.

The transient fuel compensation value, TFC_FUEL, which represents the fuel mass per injection from transient fuel compensation in lbs/cylinder, is then calculated at 207 by multiplying EFTR times a predetermined transient fuel multiplier value, TFC_MULT. If either of the comparisons performed at 206 are true, then at 208, EFTR is calculated as above and TFC_FUEL is set to zero. At 209 the value AISF is calculated for use in step 206 upon the next interrupt and the routine is exited at 210. AISF is incrementally altered at 209 by adding EFTR multiplied by DELTIME. The value TFC_TME_LST is then set equal to the value contained the real-time clock CLOCK. As discussed above, the value TFC_FUEL is used by the EEC 10 in calculating the value for the fuel injector signal transmitted via signal line 48 by adding TFC_FUEL to a base fuel value.

FIGS. 4(*a*)–4(*c*) show a transient fuel compensation routine comprising a series of steps performed by a preferred embodiment to calculate the transient fuel compensation value. The steps shown in FIGS. 4(*a*)–4(*c*) comprise a portion of the background loop which is executed continuously by the EEC 10. At 401 the signal 47 transmitted by the engine coolant temperature sensor 25 is read and stored in an engine coolant temperature variable ECT. At 402 two threshold comparisons are made to determine if the engine is operating in a proper mode for transient fuel compensation, and if an adequate amount of time from engine crank has elapsed for transient fuel compensation to begin. The first determination is made by testing a flag, UNDSP which is set to the value one by the EEC 10 if the engine is in an underspeed or crank mode. If UNDSP=0 then the engine is in neither underspeed or crank mode and transient fuel compensation may be performed, so long as an adequate amount of time has elapsed from exiting crank mode. The preferred embodiment advantageously allows a predetermined period of time, represented by a value TFCTM stored in ROM 11, to elapse after exiting crank mode in order to allow various aspects of engine operation to adequately stabilize such that accurate measurements of engine operating parameters may be made. This determination is made by comparing a value ATMR1, which corresponds to time elapsed since exiting crank mode, to the value TFCTM and performing transient fuel compensation if ATMR1 is greater than or equal to TFCTM. If transient fuel compensation is not to be performed, then the value EFFLG1 is set to zero. EFFLG1 is an equilibrium fuel flag which controls the setting of an initial value of an actual fuel mass value AISF, which represents the actual fuel film mass residing on the walls 24 of the induction system 21 when the engine is operating under transient conditions. TFC_FUEL, the transient fuel compensation value, which indicates the fuel mass per injection from transient fuel compensation, is also set to zero and the routine is exited at 408.

If EEC 10 at step 402 determines that transient fuel compensation is to be performed, then at 404 a load value, LOAD is calculated by the following relationship:

$$LOAD=CYL_AIR_CHG/SARCHG \quad (3)$$

where

SARCHG represents a standard air charge value at standard temperature and pressure obtained by dividing the engine displacement (in cubic inches) by the number of cylinders, and CYL_AIR_CHG is a value indicative of engine load and is calculated by EEC 10 as a function of mass air flow into the induction system as measured by air flow meter 17 and engine angular speed as indicated by PIP signal 45.

At 406 an equilibrium fuel mass value EISF, which is indicative of the fuel mass residing on the walls of the induction system when the engine is operating under substantially steady state operation, is calculated according to the following relationship:

$$EISF=FN1321(ECT,LOAD)*FN313(N)*MTEISF \quad (4)$$

where:

FN1321(ECT, LOAD) is a value obtained from a table contained in the ROM 11 in which are stored predetermined values indexed by the variables ECT representative of engine coolant temperature, and LOAD representative of engine load;

FN313(N) is a value obtained from a table comprising a plurality of predetermined values contained in the ROM 11 which are representative of an equilibrium intake surface fuel multiplier at a particular engine speed, N; and MTEISF is a predetermined multiplicative constant.

As indicated at 407 and 501, FIG. 4(*b*) shows the steps performed by a preferred embodiment after step 406 in FIG. 4(*a*). A preferred embodiment advantageously checks certain flags and variables at steps 502, 504, 506 and 508 in order to determine the operating mode of the engine and hence the amount of transient fuel control required. Steps 502, 504, 506 and 508 each contain certain flags and variables, the value of which determine an initial value for the actual fuel mass value AISF.

Upon an initial pass of the transient fuel compensation routine, EFFLG1 will be equal to zero, and TFCISW will be set to one or zero based upon an empirical determination of an amount of fuel required to establish a film mass on the walls of the induction system just after engine crank. Upon the first pass, if at block 502 TFCISW=1, then at 503 the actual fuel mass value AISF is set equal to the equilibrium fuel mass value EISF and the transient fuel compensation value TFC_FUEL is set to zero, meaning that the fuel injector signal is not altered by the transient fuel compensation value TFC_FUEL. At 512 TFC_FG_EN is set to zero to disable execution of steps 204 through 209 shown in FIG. 2. This advantageous feature further reduces the number of computational steps executed by EEC 10 if transient fuel control is not required. The routine is then exited at 513.

At 504 upon the initial pass, EFFLG1 will equal zero, as stated above. If TFCISW also equals zero, then at 505 AISF is set to zero, EFFLG1 is set to one and TFC_FUEL is set to zero, as in step 503. TFC_FG_EN is set to zero at 512 and the routine is then exited at 513. If at step 502 upon the initial pass TFCISW does not equal one then the routine proceeds to step 504.

At 506, a deceleration fuel shutoff flag DFSFLG is checked. If DFSFLG=1, indicating that the engine is in a deceleration fuel shutoff condition, then at 507 the actual fuel mass value AISF is calculated by multiplying the equilibrium fuel mass value EISF times a predetermined multiplier AISFM which is indicative of the fuel mass on the walls of the induction system during the deceleration fuel shutoff condition. The value TFC_FUEL is set to zero, TFC_FG_EN is set to zero at 512 and the routine is exited at 513.

If DFSFLG is not equal to one, then at 508 a series of conditions are checked to further determine the mode in which the engine is operating. TFC_IDLE_OFF is a calibration switch which disables the use of transient fuel control during engine idle. REFFLG is a flag which, when having a value of one, indicates that the engine is in an idle fuel modulation mode. ISCFLG is an idle speed control flag which indicates whether the engine is in an idle speed control mode. Idle speed control mode is an engine operating mode which actively controls engine idle speed. ISCFLG will contain a value of one or two when the engine is in one of two closed-loop rpm control modes, a value of zero or minus one when the engine is in one of two dashpot control modes. The variable N indicates engine angular speed in revolutions per minute (RPM), DSDRPM is a variable representing a desired RPM value at engine idle and TFSMN is a constant representing an RPM value above idle, below which transient fuel control is disabled. If the conditions checked at 508 result in step 509 being executed, then the actual fuel mass value AISF is set equal to the equilibrium fuel mass value EISF, meaning that the engine is essentially operating under steady state conditions, TFC_FUEL is set to zero, TFC_FG_EN is set to zero at 512 thus disabling transient fuel compensation, and the routine is exited at 513. Otherwise TFC_FG_EN is set to one at 511 to enable transient fuel control and the routine proceeds to the steps shown in FIG. 4(*c*).

As indicated at 514 and 601, FIG. 4(*c*) shows the steps performed by the preferred embodiment after step 508 in FIG. 4(*b*). At 602 the value TFC_SLOPE is calculated by retrieving and multiplying, as shown below, two predetermined values, the first being a function of engine coolant temperature and the second being a function of engine angular speed:

$$TFC_SLOPE=FN312S(ECT)*FN313(N) \quad (5)$$

where,

FN312S(ECT) is a value retrieved from a table, containing a plurality of predetermined values indexed by engine coolant temperature ECT, which is indicative of a change in mass of fuel on the walls of the intake port at an equilibrium condition per unit change in engine load as a function of engine coolant temperature, and FN313(N) is a unitless value retrieved from a table, containing a plurality of values indexed by angular speed of the engine N, which is indicative of a change in fuel mass on the walls of the intake port as a function of engine angular speed. At 603, the equilibrium fuel mass value EISF is compared to the actual fuel mass value AISF to determine if the engine is under an acceleration or deceleration condition. A preferred embodiment of the present invention advantageously contains two tables, each stored in ROM 11 and indexed by a value indicative of the time elapsed since engine crank and by a value indicative of engine coolant temperature. The tables contain a plurality of valve effect values which are empirically derived and are representative of the effect of intake valve temperature on the vaporization of fuel in the induction system of the engine. One table contains valve effect values which are used if the engine is detected to be in an acceleration condition and the other table contains valve effect values which are used if the engine is detected to be in a deceleration condition. By storing different valve effect values for acceleration and deceleration conditions, a preferred embodiment allows different transient compensation values to be generated. Consequently, when the engine is under an acceleration condition, the transient fuel compensation value TFC_FUEL is generated in a manner which provides for enhanced power, and when the engine is under a deceleration condition, the transient fuel compensation value is generated in a manner which provides for enhanced air/fuel control and consequently reduced emissions.

If the engine is under an acceleration condition then at 605: (a) an equilibrium fuel time constant EFTC which is representative of a rate of change of the fuel mass on the walls of the induction system while the engine is under acceleration is calculated, and (b) a TFC_MULT is calculated, which is a transient fuel multiplier value indicative of the effect of intake valve temperature on the vaporization rate when the engine is under acceleration, according to the following relationships:

$$EFTC=FN1322A(ECT,LOAD)*MTEFTC \quad (6)$$

$$TFC_MULT=FN1323A(ECT,ATMR1)*STCF*DT12S \quad (7)$$

where:

FN1322A(ECT, LOAD) is a unitless value obtained from a table, indexed by engine coolant temperature ECT and engine load LOAD, and stored in the ROM 11 which contains predetermined values representative of a transient fuel time constant for an engine under acceleration;

MTEFTC is a predetermined equilibrium fuel time constant multiplier;

FN1323A(ECT, ATMR1) is a unitless valve effect value obtained from a table, indexed by engine coolant temperature and time since engine crank, and stored in ROM 11 which contains a plurality of predetermined values representative of the effect of the changing intake valve temperature during engine warm-up on the vaporization of fuel in the induction system when the engine is under acceleration;

STCF is a conversion factor for converting time measured in seconds to time units as recognized by CPU 12; and DT12S is a variable representative of the time elapsed between adjacent rising edges of the PIP signal transmitted by the PIP sensor via signal line 45.

If at 603, the engine is determined to be under a deceleration condition then at 604, values for the variables EFTC and TFC_MULT according to the following relationships:

$$EFTC=FN1322D(ECT,LOAD)*MTEFTC \quad (8)$$

$$TFC_MULT=FN1323D(ECT,ATMR1)*STCF*DT12S \quad (9)$$

where:

EFTC is an equilibrium fuel time constant representative of a rate of change of the fuel mass on the walls of the induction system while the engine is under deceleration;

FN1322D(ECT, LOAD) is a value obtained from a table, indexed by engine coolant temperature ECT and engine load LOAD, and stored in the ROM 11 which contains predetermined values representative of a transient fuel time constant for an engine under deceleration;

MTEFTC is as explained above;

TFC_MULT is a transient fuel multiplier value indicative of the effect of intake valve temperature on the vaporization rate when the engine is under deceleration;

FN1323D(ECT, ATMR1) is a valve effect value obtained from a table, indexed by engine coolant temperature and time since engine crank, and stored in ROM 11 which contains a plurality of predetermined values representative of the effect of the changing intake valve temperature during engine warm-up on the vaporization of fuel in the induction system when the engine is under deceleration; and STCF and DT12S are as explained above.

It is to be understood that the specific mechanisms and techniques which have been described are merely illustrative of one application of the principles of the invention. Numerous modifications may be made to the methods and apparatus described without departing from the true spirit and scope of the invention.

What is claimed is:

1. A method for generating a control signal in an electronic controller, comprising the steps of:

executing a first routine in the controller to generate an approximate response value by performing the steps of, measuring a plurality of operating parameters, retrieving at least one predetermined value in response to the measured operating parameters, retrieving a first value indicative of a first measured operating parameter, said first measured operating parameter varying at a substantially faster rate than said plurality of operating parameters, and generating the approximate response value as a function of the first value and the predetermined value;

in response to a predetermined event, halting execution of the first routine, updating the approximate response value by executing a second routine which includes the steps of, measuring the first operating parameter to generate an updated first value, determining a difference value indicative of a difference between the first value and the updated first value, replacing the first value with the updated first value and updating the approximate response value as a function of the difference value;

generating said control signal as a function of at least the updated approximate response value; and restarting execution of the first routine.

2. The method as set forth in claim 1 wherein the event is generated by an interrupt.

3. The method as set forth in claim 2 wherein the interrupt is a hardware generated interrupt.

4. The method as set forth in claim 3 wherein the control signal is utilized by the controller to control the delivery of fuel to an internal combustion engine which comprises at least one combustion chamber, and wherein the interrupt is generated at a predetermined moment prior to the combustion of fuel within each combustion chamber of said engine.

5. The method as set forth in claim 3 wherein the step of updating the approximate response value further comprises the steps of:

generating a change value as a function of the difference value and a response alteration value which is indicative of a change in said response value per change in said first measured parameter; and generating said updated response value by adding the change value to the response value.

6. The method as set forth in claim 5 wherein the step of measuring the first operating parameter to generate an updated first value comprises the steps of:

measuring, over a period of time, the first operating parameter a plurality of times to generate a plurality of intermediate first values, and integrating said plurality of intermediate first values over said period of time to generate said updated first value.

7. The method as set forth in claim 6 wherein the control signal is utilized by the controller to control the delivery of fuel to an internal combustion engine which comprises at least one combustion chamber, and wherein the interrupt is generated at a predetermined moment prior to the combustion of fuel within said combustion chamber.

8. The method as set forth in claim 7 wherein said control signal is indicative of an amount of fuel to be delivered to said combustion chamber.

9. The method as set forth in claim 8 wherein the internal combustion engine further comprises an induction system comprised of at least one interior surface and wherein the response value is indicative of a mass of fuel residing on the interior surface of the induction system when the engine is operating under a substantially steady state condition.

10. The method as set forth in claim 9 wherein the first operating parameter is indicative of air flow rate into the induction system.

11. The method as set forth in claim 10 wherein the first value is indicative of air mass within said combustion chamber.

12. A method of controlling delivery of fuel to an intake port, in an internal combustion engine including an induction system comprised of an intake port, at least one interior surface including an intake valve for opening and closing the intake port and injector means for delivering fuel to a combustion chamber of the engine in an amount controlled by a fuel injector signal generated by an engine control means, the method comprising the steps of:

in a background routine executed by said engine control means, measuring a temperature value indicative of the temperature of the induction system;

determining a valve effect value indicative of the effect of intake valve temperature on the vaporization of fuel in the induction system;

generating a first value indicative of a mass of fuel residing on the interior surface of the induction system while the engine is in a steady state condition, in response to an aircharge value and the temperature value; and calculating an equilibrium fuel time constant value indicative of a rate of change of the fuel mass on the interior surface of the induction system while the engine is in a transient condition; and in an interrupt routine executed by the engine control means upon detection of a predefined interrupt signal;

measuring the mass flow rate of air entering said induction system to generate an updated value for said aircharge value;

altering said first value as a function of a second value which is indicative of the change in fuel mass on the interior surface of the induction system between said aircharge value and said updated value for the aircharge value;

generating a transient fuel compensation value as a function of said altered first value, said equilibrium fuel time constant value and said valve effect value; and generating said fuel injector signal as a function of said altered transient fuel compensation value.

13. The method as set forth in claim 12 wherein the second value is generated by the steps of:

generating a difference value indicative of the difference between said aircharge value and said updated aircharge value;

generating a third value indicative of the change in fuel mass on the walls of the intake port per change in air charge; and multiplying said difference value by said third value to generate said second value.

14. The method as set forth in claim 13 wherein the valve effect value is estimated by measuring the time elapsed from engine crank, measuring the engine coolant temperature, generating an index value from the measured time and engine coolant temperature, and retrieving a value indicative of the effect of intake valve temperature on the vaporization rate of fuel in the induction system from a first table containing a plurality of values indexed by engine coolant temperature and time elapsed from engine crank if the engine is under an acceleration condition and retrieving a value indicative of the effect of intake valve temperature on the vaporization rate of fuel in the induction system from a second table containing a plurality of values indexed by engine coolant temperature and time elapsed from engine crank if the engine is under a deceleration condition.

15. The method as set forth in claim 14 wherein the step of calculating the equilibrium fuel time constant comprises the steps of:

determining whether the engine is operating under an acceleration or deceleration condition;

retrieving a first predetermined value, from a first table containing a plurality of values indexed by the first measured temperature and the aircharge value, in response to the aircharge value and the temperature value if the engine is operating under the acceleration condition;

retrieving a second predetermined value, from a second table containing a plurality of values indexed by the first measured temperature and aircharge value, in response to the aircharge value and the temperature value if the engine is operating under the deceleration condition; and calculating the equilibrium fuel time constant as a function of the first or the second retrieved value.

16. The method as set forth in claim 15 wherein the step of calculating an equilibrium fuel mass value comprises the step of retrieving the equilibrium fuel mass value from a table containing a plurality of predetermined equilibrium fuel mass values indexed by engine coolant temperature and aircharge value.

17. The method as set forth in claim 16 wherein the step of calculating the transient fuel compensation value comprises the steps of generating an equilibrium transfer rate value, indicative of a rate of transfer of fuel from the induction system to an associated combustion chamber of the engine, by determining the difference between the updated first value and an actual fuel mass value and dividing the difference by the equilibrium fuel time constant.

18. The method as set forth in claim 17 wherein the actual fuel mass value is calculated by the steps of:

generating an initial actual fuel mass value; and subsequently altering the initial actual fuel mass value as a function of the time elapsed since the initial generation of the actual fuel mass value and as a function of the equilibrium transfer rate value.

19. In combination, an internal combustion engine comprising an induction system comprised of an intake port, an intake valve for opening and closing the intake port and injector means for delivering fuel to a combustion chamber of the engine in an amount controlled by a fuel injector signal, and a cooling system including engine coolant for dissipating heat produced by the engine, means responsive to the flow of air into the induction system for generating an airflow signal indicative of the mass flow rate of air into the induction system;

means responsive to the engine coolant for generating a temperature signal indicative of the temperature of the engine coolant;

means responsive to the rotational speed of the engine for generating an interrupt signal prior to combustion of an air/fuel mixture within each combustion chamber of said engine;

an electronic engine controller for generating the fuel injector signal comprising, a background routine comprising means responsive to the temperature signal for generating a temperature value and means responsive to a first aircharge value and the temperature value for generating an equilibrium fuel mass value indicative of the fuel mass residing within the induction system during steady state operation of the engine at the temperature value and aircharge value, and an interrupt routine, responsive to the interrupt signal, comprising means responsive to the airflow signal for updating said first aircharge value by a second aircharge value, means for determining a difference value indicative of a difference between the first and the second aircharge values, means responsive to the difference value for generating an updated equilibrium fuel mass value, and means responsive to the updated equilibrium fuel mass value for generating the fuel injector signal.

* * * * *